US008440894B2

(12) United States Patent
Amland

(10) Patent No.: US 8,440,894 B2
(45) Date of Patent: May 14, 2013

(54) DEVICE FOR SUPPORTING A STRING MUSICAL INSTRUMENT

(76) Inventor: Egil Amland, Skjetnamarka (NO)

( * ) Notice: Subject to any disclaimer, the term of this patent is extended or adjusted under 35 U.S.C. 154(b) by 0 days.

(21) Appl. No.: 13/122,618

(22) PCT Filed: Oct. 13, 2009

(86) PCT No.: PCT/NO2009/000357

§ 371 (c)(1),
(2), (4) Date: May 4, 2011

(87) PCT Pub. No.: WO2010/050818

PCT Pub. Date: May 6, 2010

(65) Prior Publication Data

US 2011/0219935 A1 Sep. 15, 2011

(30) Foreign Application Priority Data

Oct. 16, 2008 (NO) ..... 20084333

(51) Int. Cl.
*G10D 3/00* (2006.01)

(52) U.S. Cl.
USPC ..... 84/327

(58) Field of Classification Search ..... 84/327; 206/14
See application file for complete search history.

(56) References Cited

U.S. PATENT DOCUMENTS

| | | | | | |
|---|---|---|---|---|---|
| 303,745 | A * | 8/1884 | Orth | 206/14 |
| 414,231 | A * | 11/1889 | Loring | 206/14 |
| 973,500 | A * | 10/1910 | Gunther | 206/14 |
| 2,419,823 | A * | 4/1947 | Cross et al. | 40/753 |
| 2,553,174 | A * | 5/1951 | Cross | 248/459 |
| 3,251,258 | A * | 5/1966 | Parker | 84/453 |
| 3,866,877 | A * | 2/1975 | Thompson | 248/688 |
| 4,656,917 | A * | 4/1987 | Van Halen | 84/327 |
| 4,693,161 | A * | 9/1987 | Uhrig | 84/327 |
| 5,197,701 | A * | 3/1993 | Olson | 248/166 |
| 5,234,190 | A * | 8/1993 | Cross | 248/459 |
| 5,833,051 | A * | 11/1998 | Tiefenbrun et al. | 206/14 |
| 6,130,375 | A * | 10/2000 | Kellogg et al. | 84/327 |
| 6,145,801 | A * | 11/2000 | Herring, Jr. | 248/463 |
| 6,422,522 | B1 * | 7/2002 | Woollen | 248/166 |
| 6,603,067 | B1 * | 8/2003 | Woollen | 84/327 |
| 6,672,549 | B2 * | 1/2004 | Kolb | 248/127 |
| 7,208,666 | B2 * | 4/2007 | Burch et al. | 84/327 |
| 8,063,291 | B2 * | 11/2011 | Crowder et al. | 84/327 |
| 8,162,282 | B2 * | 4/2012 | Hu et al. | 248/447 |
| 2004/0182984 | A1 * | 9/2004 | Sandkuhl | 248/443 |
| 2007/0158509 | A1 * | 7/2007 | Hubbell | 248/171 |
| 2009/0100981 | A1 * | 4/2009 | Chadwick, V | 84/293 |
| 2010/0059409 | A1 * | 3/2010 | Crowder et al. | 206/757 |
| 2010/0308202 | A1 * | 12/2010 | Hu et al. | 248/685 |
| 2011/0203952 | A1 * | 8/2011 | Loban | 206/314 |
| 2011/0219935 | A1 * | 9/2011 | Amland | 84/327 |

* cited by examiner

FOREIGN PATENT DOCUMENTS

| | | | |
|---|---|---|---|
| GB | 2423624 | A * | 8/2006 |
| SE | 0702110 | | 3/2009 |

*Primary Examiner* — David Warren
*Assistant Examiner* — Robert W Horn
(74) *Attorney, Agent, or Firm* — Ladas & Parry LLP

(57) ABSTRACT

Device for supporting a guitar (1) or another string instrument, with a support (2) which is fastened on its upper part to a guitar body (9) in a lockable hinge (4). In an unfolded position the support (2) creates an angle at approximately 45° to the length axis through the guitar body (9), in such manner that the guitar can rest on the support (2). When mounted on an electric guitar the support is placed in grooves at the back of the guitar, and can be pivoted from the guitar body when the locking mechanism is released.

8 Claims, 3 Drawing Sheets

DEVICE FOR SUPPORTING A STRING MUSICAL INSTRUMENT

BACKGROUND OF THE INVENTION

This invention relates to a supporting arrangement for a string instrument.

During concerts the musicians frequently are playing different instruments. Even when the instruments used are not quite different, there may be different types of similar instruments, as e.g. acoustic guitars and electric guitars. Also then there may be a need for putting the instrument aside for later use.

In connection with a concert such changes may take place fast and the instruments are often precious and they ought to be handled with great care. Accordingly there is a need for simple and easily accessible supporting device or stand to keep the instrument safely supported also when not in use. Although it is not desirable to have the scene crowded by stands required for different instruments. The scene area may be crowded with technical equipment and some of the musicians will also want to move freely around and accordingly the scene room should be filled up by least possible equipment.

Also when small locations are concerned, as e.g. in an ordinary living room, there will be a need to support the instrument. In such environments the instruments should not be placed on the floor as it easily may be stumbled in. On the other side it may be desired to put the instrument aside for a certain period, and if the instrument is arranged balancing toward a wall or a piece of furniture, this may easily jeopardize a precious instrument which may fall down and be damaged.

DESCRIPTION OF RELATED ART

In U.S. Pat. No. 5,197,701 a stand for supporting an instrument such as a guitar, is shown. The stand is herein fastened on the back of the guitar and it will be awkward during playing.

In U.S. Pat. No. 4,693,161 and in the pending patent application US 2004/0182984 A1 different supports for an instrument is also described. Folded down, these support legs will be awkward during playing.

From U.S. Pat. No. 4,192,134 (Mixon m.fl.) it is known to attach a ring on the edge of a string instrument with a hinge at the lower end, to pivot this ring downward to a support position, wherein the ring is resting on the floor or another base. For a string instrument with a circular body, this may function, as lonq as it is possible to design the hinge in such a way that it will withstand the momentum from the instrument resting on the ring. This will however place special demands on the locking mechanism of the hinge, and place restrictions on the design of the hinge.

SUMMARY OF THE INVENTION

The main object of the present invention is to provide a support arrangement which allows putting down a guitar or another string instrument in an upright position, so that it easily may be gripped when desired to be played on. This solution should be available both during concerts as in more informal occasions.

The support arrangement should not represent any hindrance or problem for the musicians.

Still a further object is that neither the supporting device nor its fastening means shall influence negatively the sound of the instrument.

The above listed objects may be obtained with a support arrangement for a guitar or a similar string instrument with a support being pivotably attached to the back of the instrument and which can be pivoted away from the instrument when this is to be arranged standing, characterized in that the support with its attachment means and the instrument body are integrated, to have no protruding part when the pivotable support is close to the instrument. These features and further details of the invention are described further in the following description of examples.

The term "supporting arrangement" is intended to cover all parts included in the design, including hinge part and locking mechanism, in addition to the active support part.

BRIEF DESCRIPTION OF THE DRAWINGS

Description of the Preferred Embodiments

Figure 1:
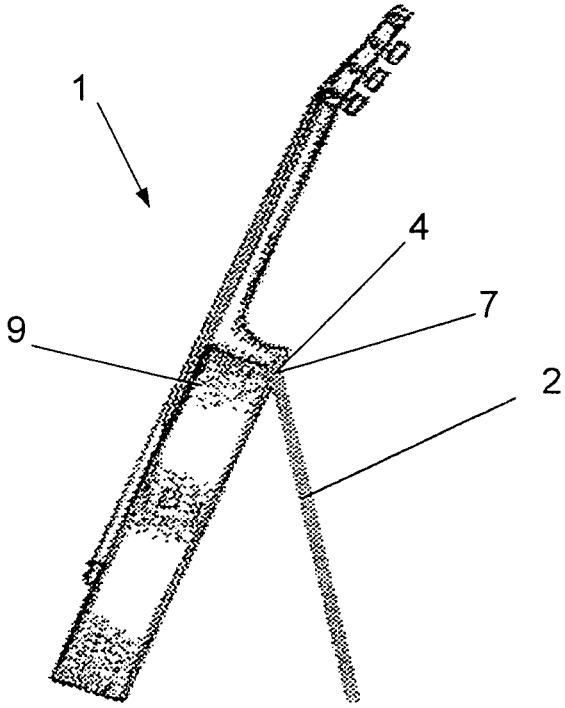

The Figures are showing examples of embodiments:

FIG. 1 shows a side view of an acoustic guitar supported by a stand arranged according to the present invention.

Figure 2:
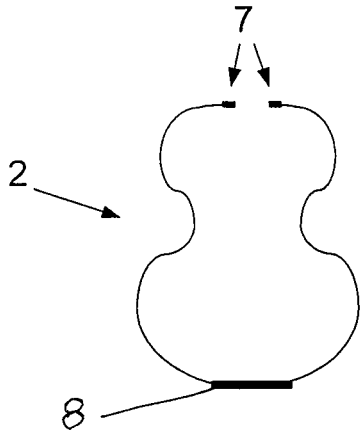

FIG. 2 shows a front view of the support arrangement of FIG. 1.

Figure 3:
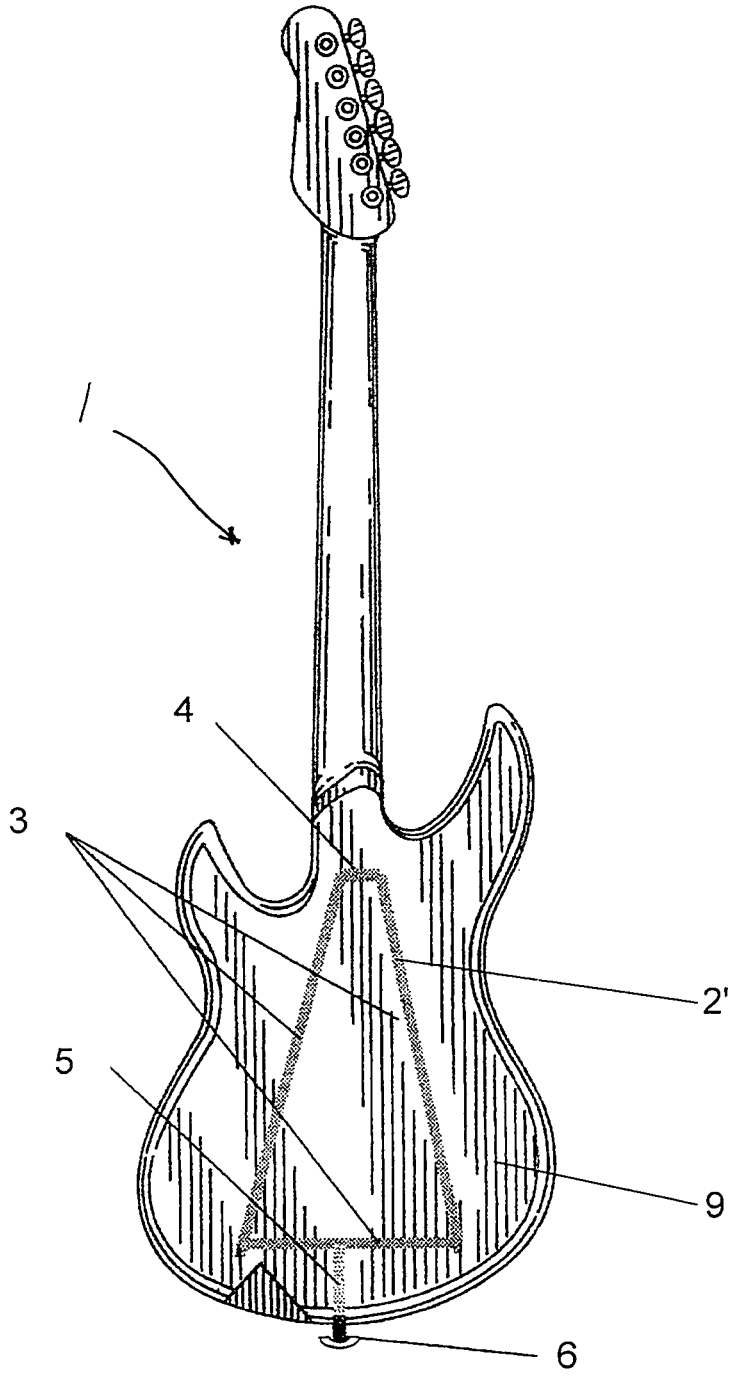
Figure 4:
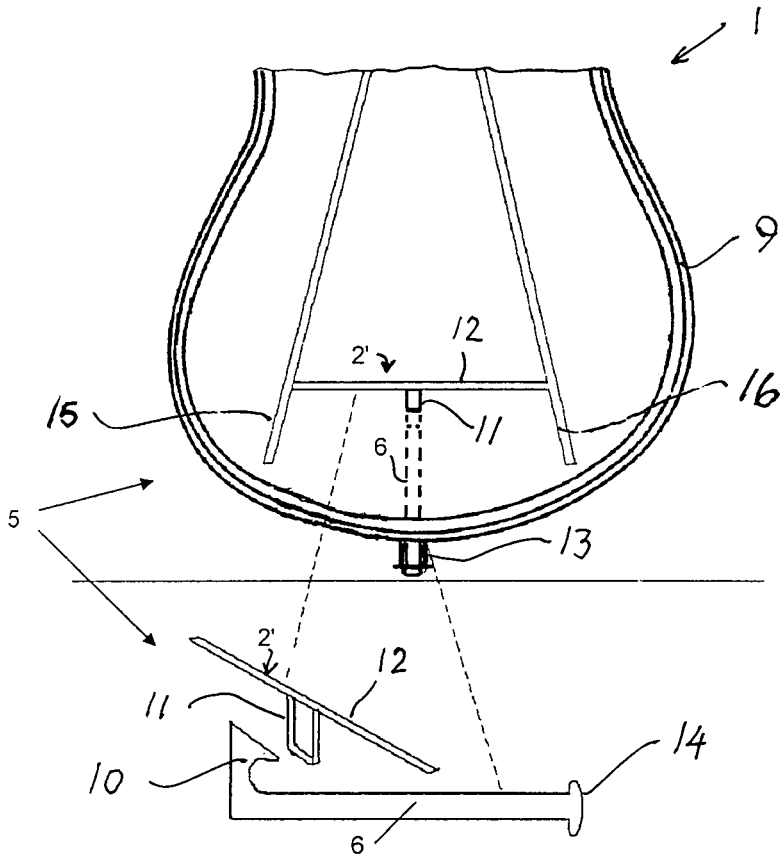

FIG. 3 shows a back view of an electric guitar having a further embodiment of the invention, while FIG. 4 shows schematically details of the locking mechanism in FIG. 3.

The same reference number on different figures is showing the same or a corresponding part.

FIG. 1 shows side view of an acoustic guitar 1, having a support frame 2 folded out. The support frame 2, being shown schematically in FIG. 2, comprises a frame element adapted to the rim of the guitar body 9, said rim being provided with an edge groove to accommodate the frame totally or partly. The support frame 2 thus will be lowered into the instrument with few or none protruding parts.

The connection between the support frame 2 and the remaining part of the guitar is provided by a hinge 4 at the upper part of the guitar body. The upper ends 7 of the support frame 2 is providing a part of the hinge 4 by engaging recesses in the part attached to the guitar 1. The hinge 4 is designed to have two end positions, an inner position with the support close to the guitar body, and an outer, with a resting position making an angle of approximately 45°.

The support frame 2 has at its lower end, which in the active position is engaging the floor, a straight support 8 providing stability to the support frame 2 in its engagement with the base.

When the guitar 1 is being used, the support frame 2 is folded close to the guitar body in such a manner that it does not represent any disturbance or in any manner introduces a disturbing element for the musician.

For an acoustic guitar 1 it is essential that the sound of the guitar is not affect by changing the resonance chamber. Accordingly the support frame is designed to have a corresponding shape as the body 9 of the guitar, so that it may be folded close to the guitar body 9 along the edge between the back wall and the side wall of the guitar. Accordingly the back wall is disturbed as little as possible.

FIG. 3 shows an embodiment of the invention for an electric guitar, viewed from the back. A groove 3 is provided in a triangular design in its back wall for accommodating a triangular support frame 2'. In FIG. 4, this frame is shown with two protruding legs 15, 16.

At the top, the support frame 2' is pivotably attached to the guitar body 9 with a hinge. 4. The hinge 4 may be of prior art design, with a spring biasing the support frame against open position, with an angle up to approximately 45°.

For locking the support frame 2', a locking mechanism with the general reference numeral 5 is integrated at the lower part of the guitar body.

FIG. 4 shows further details of the locking mechanism 5 in FIG. 3. It comprises a locking bar 6 with a schematically shown hook 10 at the inner end, which is provided to catch a loop 11 on the lower web 12 of the support frame 2'. The hook 10 is maintained biased toward locking position by a screw spring 13 arranged under the external part of the locking bar 6, under a head 14, said locking bar extending through a channel in the guitar body 9, to the groove for the support frame 2'.

When it is desirable to play on the guitar 1, the support frame 2' is pressed into the groove at the back of the guitar body.

To lock the support frame 2' to the guitar body, a magnet attached to the guitar body 9 can also be used. Further locking alternatives may be conceived, e.g. by pressing the support frame 2' over a biased peak.

The end of the locking bar 6, with the head 14, may serve for attaching a guitar strap. The locking of the locking bar 6 and the hook 10 may be released by pressing the head of the locking bar 6 protruding et the lower end of the instrument. The pressure has to exceed the force of the spring 14, to press the locking bar 6 into the instrument body 9, releasing the end of the locking bar 6 from the loop 11 on the crossing web 12 of the support 2'. The support 2' will then pivot into an open position.

By integrating the support arrangement in the instrument, no support stands will crowd the scene or the room used for playing. The integration is provided in such a way that it leaves no protruding edges or recesses, whereby clothing, cables or other things which may be stuck to the instrument when used.

When the musician decide to leave the guitar standing, the support is withdrawn or is released automatically by releasing a locking mechanism (e.g. by pressing the guitar strap attachment), to leave the support in an angle of approximately 45° to the longitudinal axis of the guitar.

MODIFICATIONS

The invention is not limited for use on guitars only. The support 2 for an acoustic guitar may be adapted for a cello or another kind of string instrument.

The stand according to the invention may also be integrated in a board which may be attached to the back of an instrument.

The invention claimed is:

1. Support arrangement for a guitar or a similar string instrument with a support (2, 2') being pivotably attached by an attachment means to the back of the instrument and which can be pivoted away from the instrument when the instrument is arranged in a standing position, characterized in that the support (2, 2') with its attachment means are integral with the instrument body, such that there are no protruding parts when the pivotable support (2, 2') is close to the instrument.

2. Support arrangement according to claim 1, characterized in that a groove for the support (2, 2') is provided at the back of the instrument body (9).

3. Support arrangement according to claim 1, characterized in that the support is arranged embedded in an element mounted on the back of an instrument body.

4. Support arrangement according to claim 1, characterized in that the support at its upper end is attached with a lockable hinge (4).

5. Support arrangement according to claim 1, characterized in that the support (2') is triangular with diverging legs.

6. Support arrangement according to claim 1, characterized in that the support (2') at its free end is arranged to cooperate with a locking element (6) being an member in a locking arrangement (5) at the base of the instrument, which is keeping the support (2') in its closed position.

7. Support arrangement according to claim 5, characterized in that the support (2') is biased by a spring, to be automatically released when the locking arrangement (5) is released.

8. Support arrangement according to claim 1, where the support is provided as a frame (2) at the edge of the back of the instrument, characterized in that the frame (2) is hinged at its upper end (at 4) and that a linear, crosswise extending support element (8) is arranged at the lower side.

* * * * *